US008132684B2

(12) United States Patent
Gnepper et al.

(10) Patent No.: US 8,132,684 B2
(45) Date of Patent: Mar. 13, 2012

(54) CHILD-RESISTANT CLOSURE, PACKAGE AND METHOD OF MAKING

(75) Inventors: Maurice R. Gnepper, Fremont, OH (US); John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 1386 days.

(21) Appl. No.: 11/181,130

(22) Filed: Jul. 14, 2005

(65) Prior Publication Data

US 2007/0012645 A1 Jan. 18, 2007

(51) Int. Cl.
*B65D 55/02* (2006.01)

(52) U.S. Cl. ..... 215/221; 215/222; 215/252; 215/228; 220/212

(58) Field of Classification Search ..... 215/252, 215/222, 332, 228, 201, 221; 220/212
See application file for complete search history.

(56) References Cited

U.S. PATENT DOCUMENTS 3,339,770 A * 9/1967 Weigand ..... 215/214
3,613,928 A * 10/1971 Landen ..... 215/214
3,613,929 A 10/1971 Treanor
3,695,475 A 10/1972 Ruekberg
3,695,476 A 10/1972 Ruekberg
3,809,276 A * 5/1974 Landen ..... 215/332
3,874,540 A * 4/1975 Hidding ..... 215/252
3,880,314 A 4/1975 Akers
3,917,096 A * 11/1975 Hedgewick ..... 215/211
3,931,891 A * 1/1976 Peppler ..... 206/538
3,951,289 A * 4/1976 Landen ..... 215/211
3,991,895 A 11/1976 Thornton
4,119,232 A 10/1978 Thornton
4,133,462 A 1/1979 Lindstrom
4,257,526 A * 3/1981 Weits et al. ..... 215/332
4,337,869 A 7/1982 Guinle
4,346,809 A * 8/1982 Kusz ..... 215/214
4,383,619 A * 5/1983 Mumford et al. ..... 215/222
4,579,238 A * 4/1986 Herr ..... 215/211
(Continued)

FOREIGN PATENT DOCUMENTS

DE 29714103 U1 10/1997
(Continued)

OTHER PUBLICATIONS

Drawing SD-1-0239, SD-1-0240 and SD-1-0241 illustrative of commercial "Caution Plug Cap" commercial packages.

*Primary Examiner* — Anthony Stashick
*Assistant Examiner* — Christopher McKinley
(74) *Attorney, Agent, or Firm* — Reising Ethington PC

(57) ABSTRACT

A closure includes a skirt and internal lugs on the skirt. The skirt has an undulating circumferential contour that includes alternate outwardly convex and outwardly concave portions, with the internal lugs being disposed within the outwardly concave portions of the skirt. The skirt preferably is sufficiently flexible to allow the outwardly concave portions of the skirt to assume an outwardly convex geometry as a result of outward pressure on the internal lugs during demolding of the closure. The closure thus may be simply axially stripped from the mold core during the demolding operation without requiring movement of portions of the mold core to clear a path for travel of the lugs. The lugs preferably are shaped as an inverted U that opens toward a free edge of the skirt, further to facilitate demolding of the closure.

31 Claims, 4 Drawing Sheets

U.S. PATENT DOCUMENTS

| | | | | |
|---|---|---|---|---|
| 4,697,714 | A | 10/1987 | Towns et al. | |
| 5,213,223 | A * | 5/1993 | Minnette | 215/216 |
| 5,320,233 | A * | 6/1994 | Welch | 215/252 |
| 5,449,078 | A | 9/1995 | Akers | |
| 5,826,738 | A * | 10/1998 | Minh | 215/206 |
| 5,891,380 | A | 4/1999 | Larue et al. | |
| 5,950,850 | A * | 9/1999 | Takamatsu et al. | 215/252 |
| 6,378,713 | B2 * | 4/2002 | Montgomery | 215/222 |
| 6,446,823 | B2 | 9/2002 | Miceli et al. | |
| 6,637,611 | B2 * | 10/2003 | Luch | 215/256 |
| 7,165,692 | B2 * | 1/2007 | Konefal et al. | 215/220 |
| 7,198,170 | B2 * | 4/2007 | Herr | 220/293 |
| 7,527,160 | B2 * | 5/2009 | Shingle | 215/228 |
| 2005/0252877 | A1 * | 11/2005 | Moller | 215/222 |
| 2006/0273060 | A1 * | 12/2006 | Fricke | 215/222 |

FOREIGN PATENT DOCUMENTS

| | | | |
|---|---|---|---|
| FR | 2039503 | A | 1/1971 |
| WO | WO 2004065243 | A1 * | 8/2004 |

* cited by examiner

CHILD-RESISTANT CLOSURE, PACKAGE AND METHOD OF MAKING

The present disclosure relates to child-resistant closures and packages, such as prescription packages for example, and to methods of making closures for such packages.

BACKGROUND AND SUMMARY OF THE DISCLOSURE

U.S. Pat. Nos. 4,057,159, 4,059,198 and 4,485,932 disclose child-resistant prescription packages that include a container or vial, a closure, and a spring/seal disk disposed between the closure and the container. The closure has a skirt with internal lugs that cooperate with locking notches on external projections around the mouth of the container for securing the closure to the container. An internal abutment on the closure cooperates with the spring/seal disk to urge the closure away from the container so that the lugs are resiliently captured within the notches. When it is desired to remove the closure, the closure must be pushed toward the container (and/or the container pushed toward the closure) so that the lugs clear the notches and the closure may be rotated off of the container. When the closure is assembled to the container, the lugs cam beneath convex surfaces on the container projections against the force of the spring element until the lugs snap into the notches on the projections.

The internal lugs on the closure skirt must be of relatively sharp contour so that the closure cannot readily be simply pried or pulled off of the container. For this reason, the closures cannot readily be simply axially stripped from the mold core following the molding operation. Rather, the mold core typically must be of relatively complex construction with an end portion that rotates with respect to the remainder of the core to clear a path for axial travel of the lugs when the closure is removed from the core. One objective of the present disclosure is to provide a closure of the described type that is constructed to facilitate simple axial stripping of the closure from the mold core during the demolding operation. Another objective of the present disclosure, which may be implemented separately from or in combination with the first objective of the disclosure, is to provide a closure and a package that are readily convertible from child-resistant operation to non-child-resistant operation.

The present disclosure includes a number of aspects that can be implemented separately from or in combination with each other.

A closure in accordance with one aspect of the present disclosure includes a skirt and internal lugs on the skirt. The skirt has an undulating circumferential contour that includes alternate outwardly convex and outwardly concave portions, with the internal lugs being disposed within the outwardly concave portions of the skirt. The skirt preferably is sufficiently flexible to allow the outwardly concave portions of the skirt to assume an outwardly convex geometry as a result of outward pressure on the internal lugs during demolding of the closure. The closure thus may be simply axially stripped from the mold core during the demolding operation without requiring movement of portions of the mold core to clear a path for travel of the lugs. The lugs preferably are shaped as an inverted U that opens toward a free edge of the skirt, further to facilitate demolding of the closure.

A package having child-resistant and non-child-resistant modes of operation, in accordance with another aspect of the present disclosure, includes a container having an open end and at least one external engagement element spaced from the open end. A closure has a base wall, a skirt extending from the base wall, and at least one internal engagement element on the skirt for engaging the at least one external engagement element on the container in a child-resistant mode of operation. At least a portion of the skirt containing the internal engagement element is severable from the remainder of the closure for non-child-resistant operation of the closure. An annular wall extending from the base wall within the skirt engages the open end of the container, and an annular pocket is disposed on the external surface of the annular wall adjacent to the base wall for snap-receipt of the open end of the container in the non-child-resistant mode of operation. In the exemplary embodiment of the disclosure, the at least one internal engagement element on the closure skirt includes angularly spaced internal lugs, and the at least one external engagement element on the container includes a corresponding number of external projections with undersurface notches. However, other engagement elements, such as interlocking threads with locking lugs and gaps, also are contemplated.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
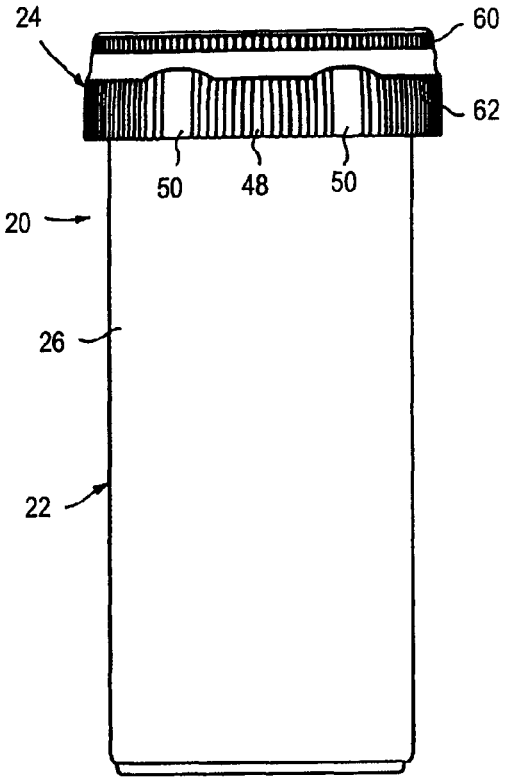
FIG. 1 is a side elevational view of a child-resistant package in accordance with an exemplary embodiment of the disclosure.
Figure 2:
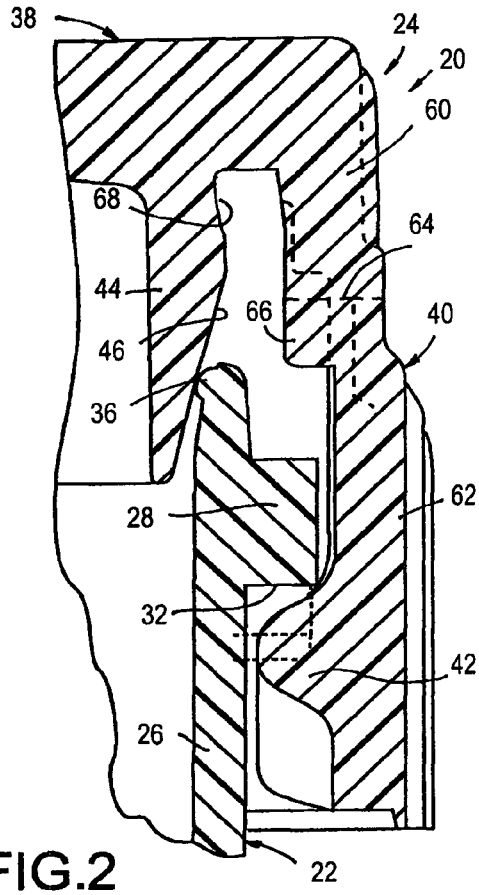
FIG. 2 is a fragmentary sectional view on an enlarged scale of a portion of the package illustrated in FIG. 1.
Figure 3:
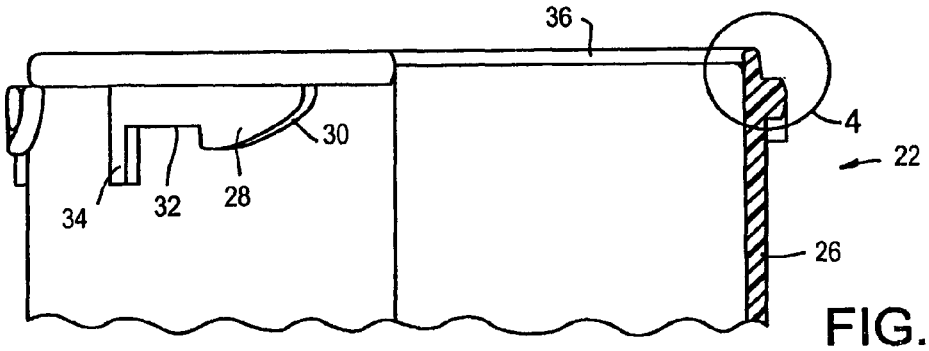
FIG. 3 is a fragmentary partially sectioned side elevational view of the container in the package of FIGS. 1 and 2.
Figure 4:
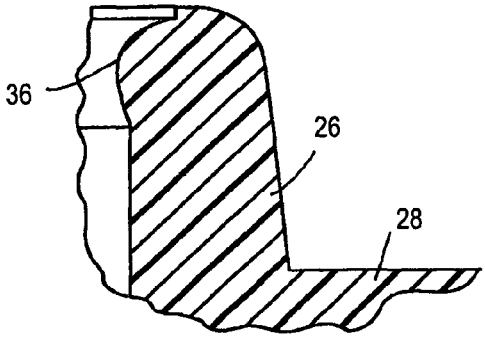
FIG. 4 is a fragmentary sectional view on an enlarged scale of the portion of FIG. 3 within the area 4.
Figure 5:
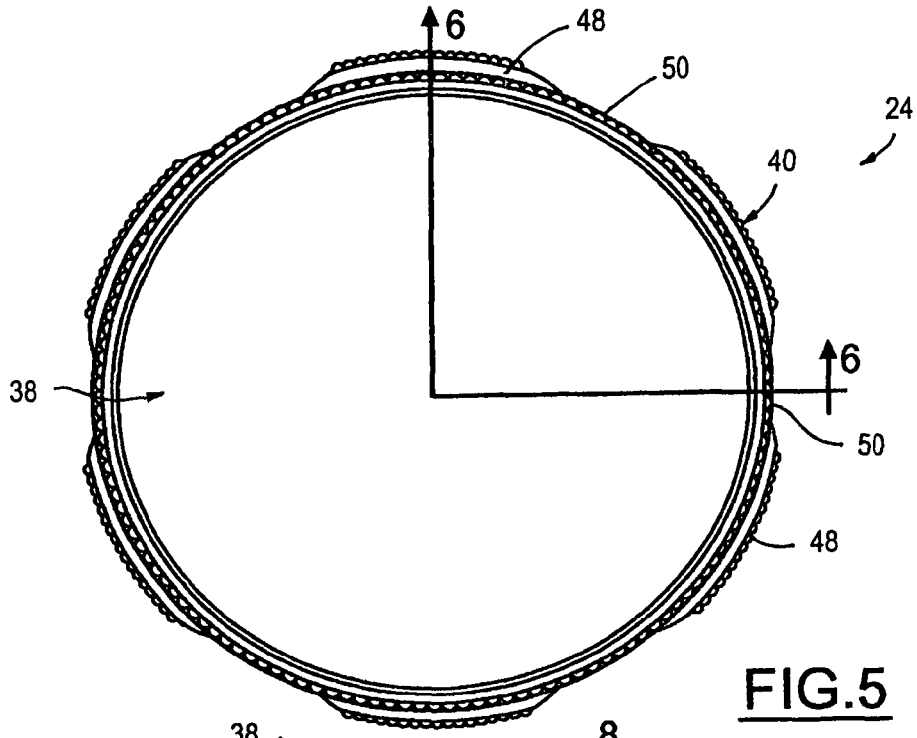
FIG. 5 is a top plan view of the closure in the package of FIGS. 1 and 2.
Figure 6:
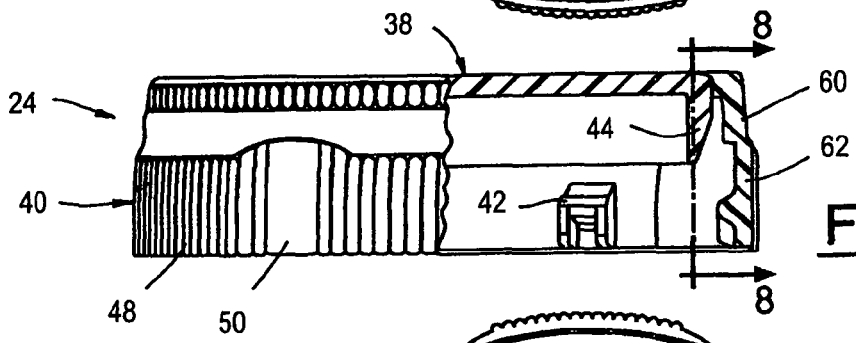
FIG. 6 is a partially sectioned elevational view taken substantially along the line 6-6 in FIG. 5.

FIGS. 1-2 illustrate a child-resistant package 20, in accordance with an exemplary embodiment of the disclosure, as including a container or vial 22 to which a closure 24 is releasably secured. Referring to FIGS. 1-4, container 22 includes a body 26 having an open end. A series of external projections 28 are provided in an angularly spaced circumferential array around an external surface of container body 26 at a position spaced from the open end of the container. Each projection 28 includes an undersurface with a cam portion 30, a notch 32 and a stop 34. An internal bead 36 extends around the open end of the container. Bead 36 preferably is circumferentially continuous as shown. Container 22 may be of any suitable construction, such as injection molded or blow molded polypropylene. The generally cylindrical geometry of container body 26 is shown by way of example only, and the container body can be of any desired shape.

Closure 24 (FIGS. 1-2 and 5-11) includes a base wall 38 from which a peripheral skirt 40 extends. Skirt 40 has a circumferential array of internal lugs 42 at angular spacing and positions for engagement with external projections 28 on container 22. A circumferentially continuous annular wall 44 extends from base wall 38 at a position spaced radially inwardly from skirt 40. Annular wall 44 has an external surface 46 for internal engagement with the open end of the container (FIG. 2) as closure 24 is applied to the container. Thus, in the assembled condition of FIG. 2, surface 46 of annular wall 44 is in plug-sealing engagement with the open end of the container. Wall 44 also flexes the end portion of the container wall radially outwardly to provide the spring force that holds lugs 42 within notches 32 of projections 28. (The container wall could flex the closure wall radially inwardly and/or both walls could flex in accordance with the broadest aspects of the disclosure.) To open package 20, closure 24 and/or container 22 are pushed axially toward each other, against the force of annular wall 44 against the open end of the container, until lugs 42 clear notches 32, at which point closure 24 may be rotated counterclockwise to clear projections 28. To apply the closure to the container, lugs 42 are rotated into engagement with cam surfaces 30 of projections 28, following which continued rotation causes annular wall 44 to flex and resiliently expand the container end radially outwardly (and/or the closure wall radially inwardly) until internal lugs 42 snap into notches 32. Closure 24 preferably is of one-piece integrally molded plastic construction such as polypropylene.

Figure 7:
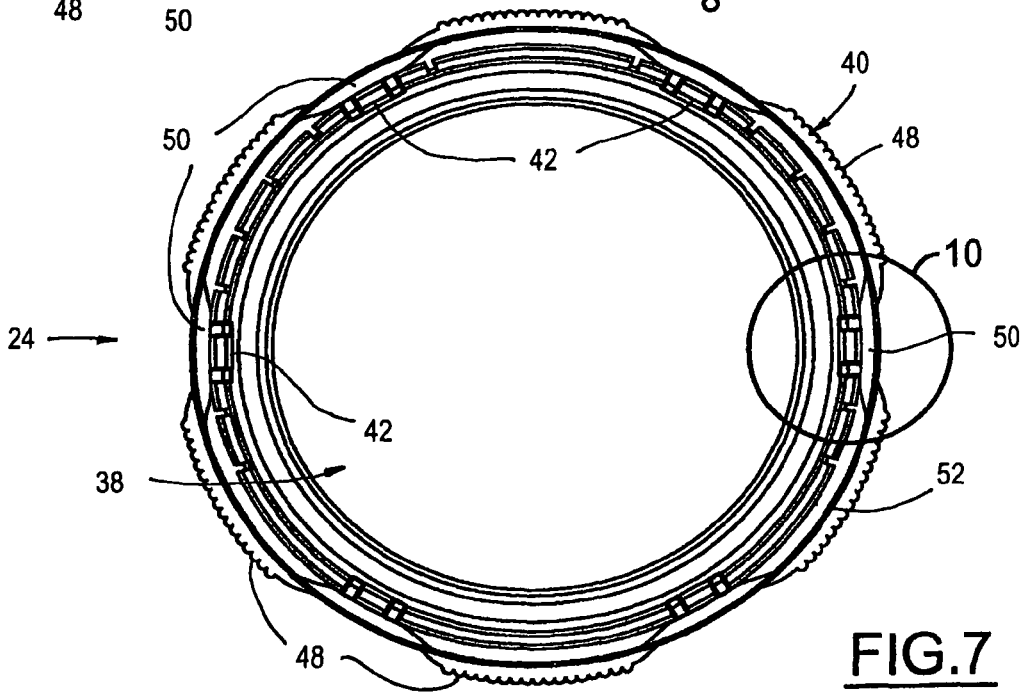
FIG. 7 is a bottom plan view of the closure in FIGS. 5 and 6.
Figure 10:
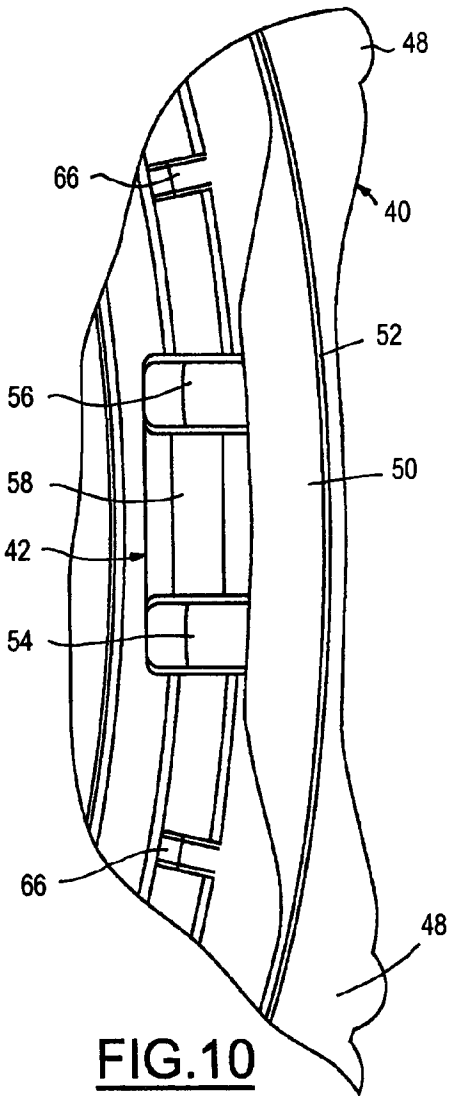
FIG. 10 is a fragmentary plan view on an enlarged scale of the portion of FIG. 7 within the area 10.
Figure 9:
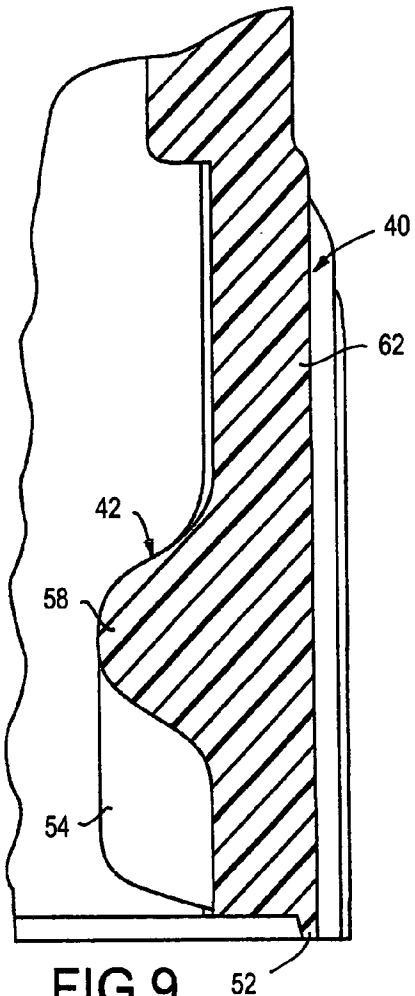
FIG. 9 is a fragmentary sectional view taken substantially along the line 9-9 in FIG. 8.
Figure 8:
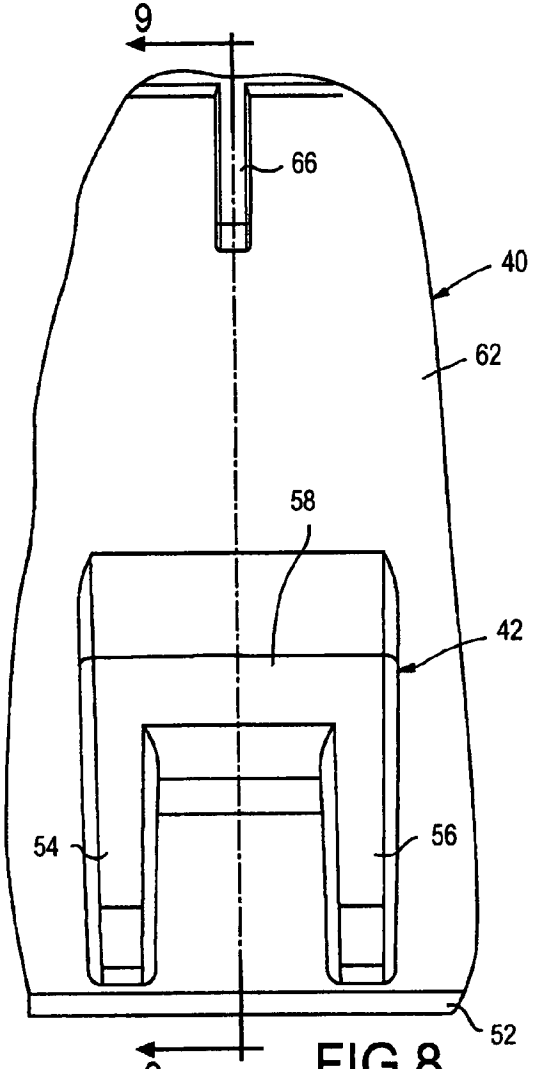
FIG. 8 is a fragmentary sectional view taken substantially along the line 8-8 in FIG. 6.
Figure 11:
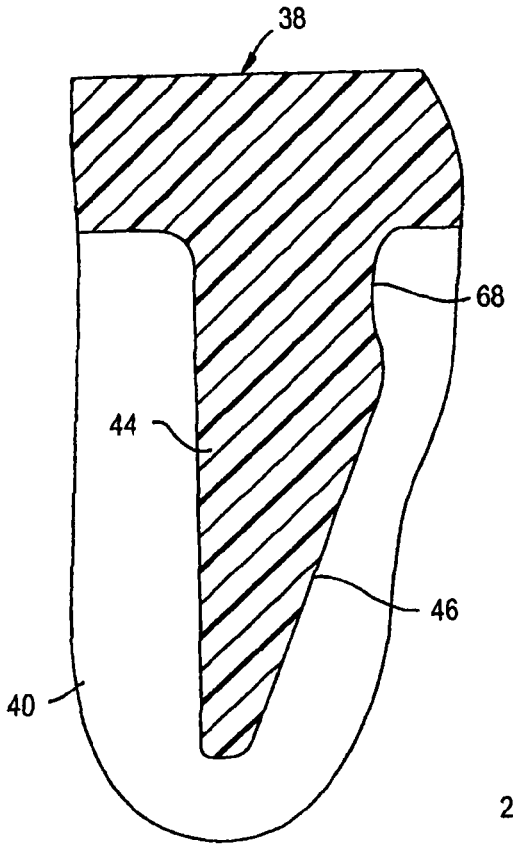
FIG. 11 is a fragmentary sectional view on an enlarged scale of a portion of the closure in FIG. 6.

In accordance with one aspect of the present disclosure best illustrated in FIGS. 5-10, closure skirt 40 has an undulating circumferential contour that includes angularly spaced outwardly convex portions 48 alternating with angularly spaced outwardly concave portions 50. Convex portions 48 and concave portions 50 preferably form a circumferentially continuous skirt 40, which preferably is of substantially uniform wall thickness as best seen in FIGS. 7 and 10. Lugs 42 are disposed, preferably centrally disposed, on the inside surfaces of outwardly concave skirt portions 50. In the illustrated exemplary embodiment of the disclosure, there are six lugs 42 at nominally equal angular spacings of 60° from each other. There thus are six outwardly concave portions 50 alternating with six outwardly convex portions 48 in the illustrated embodiment, with portions 48 and 50 each having an arcuate dimension of about 30°. During demolding of the closure, lugs 42 may be simply axially stripped from the mold core. During this stripping operation, outward pressure on lugs 42 from the mold core causes outwardly concave portions 50 of closure skirt 40 to assume an outwardly convex geometry, so that skirt 40 will be substantially cylindrical during the demolding operation. After lugs 42 clear the mold core, the resilient flexibility of skirt 40 causes portions 50 to reassume the outwardly concave geometries illustrated in the drawings. An annular lip 52 (FIGS. 7-10) extends around the free edge of skirt 40 through portions 48,50.

In accordance with another aspect of the present disclosure best seen in FIGS. 2 and 6-9, each lug 42 preferably has the shape of an inverted U, as viewed from within skirt 40, that opens downwardly toward a free edge of the skirt. (Directional words such as "upward" and "downward" are employed by way of description and not limitation with respect to the upright orientations of the closure, container and package illustrated in FIGS. 1-4, 6, 8-9 and 11-12. Directional words such as "radial" and "axial" are employed by way of description and not limitation with respect to the axes of the closure skirt and/or the container mouth as appropriate.) Each lug 42 thus has a pair of angularly spaced legs 54,56 that are interconnected by a bridge 58. The preferred inverted U-shaped geometry of lugs 42, having a hollow downwardly opening interior, further enhances stripability of the closure from the mold core.

Closure 24, in accordance with yet another aspect of the present disclosure, preferably is convertible from a child-resistant mode of operation, previously described in connection with FIGS. 1 and 2, to a non-child-resistant mode of operation illustrated in FIGS. 12 and 13. In accordance with this aspect of the disclosure, closure skirt 40 preferably includes an upper portion 60 contiguous with the periphery of closure base wall 38 and a lower portion 62 on which internal lugs 42 are disposed. (It is lower portion 62 of skirt 40 that preferably is of undulating circumferential contour in accordance with another aspect of the disclosure discussed above, while skirt portion 60 preferably is cylindrical.) Lower skirt portion 62 is frangibly connected to upper skirt portion 60 along the line 64 (FIG. 2). In the illustrated embodiment of the disclosure, leaders 66 are molded onto the inside surface of skirt 40 and form frangible bridges when the closure shell is scored along the line 64. As an alternative, leaders 66 may be deleted, and the frangible bridges can be formed in a single- or double-scoring operation. As another alternative, skirt portion 62 may be frangibly connected to skirt portion 60 by a frangible web, or by bridges that are formed during the closure molding operation—i.e., not requiring a post-molding scoring operation.

Figure 12:
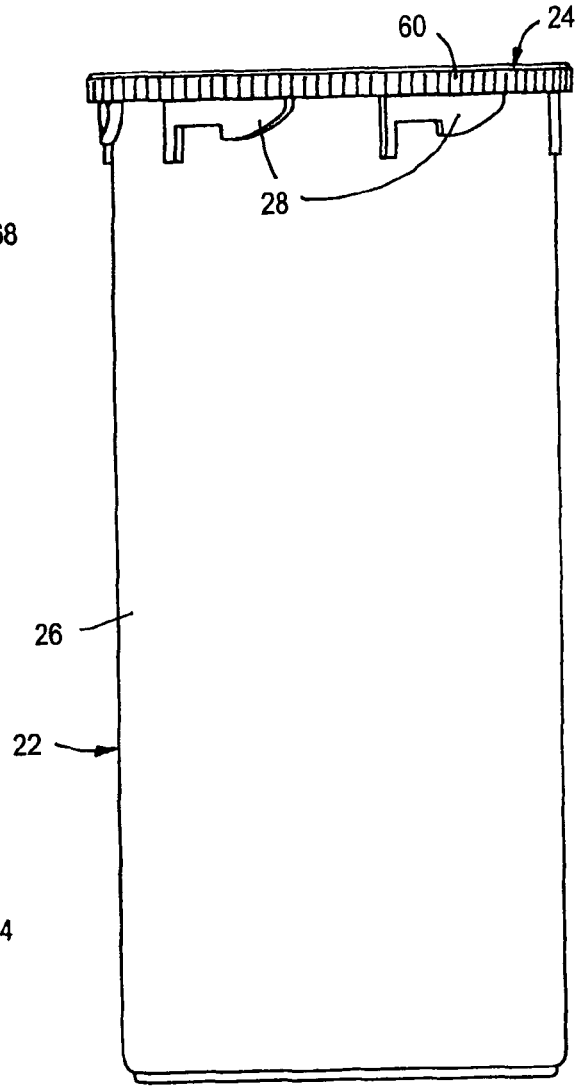
FIG. 12 is a side elevational view of the package of FIG. 1 in a non-child-resistant mode of operation.
Figure 13:
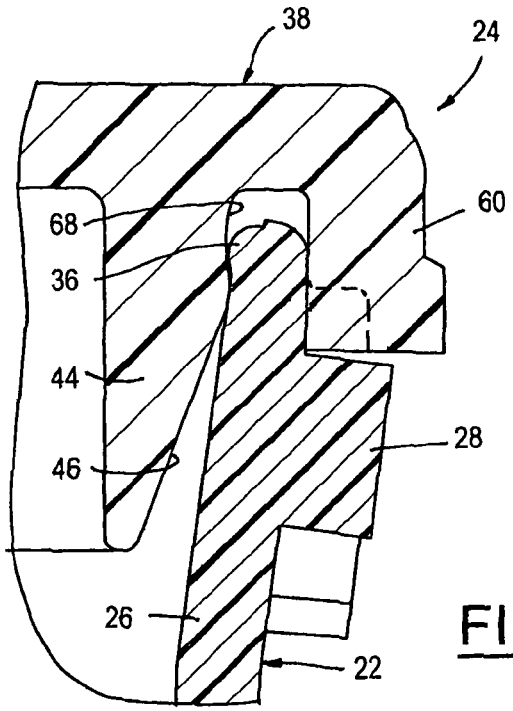
FIG. 13 is a fragmentary sectional view on an enlarged scale of a portion of the package illustrated in FIG. 12.

Closure 24 may be converted from a child-resistant mode of operation illustrated in FIGS. 1 and 2 and discussed above to the non-child-resistant mode of operation illustrated in FIGS. 12 and 13 by severing skirt portion 62 from the remainder of the closure. This may be done manually by a user or a packager (such as a pharmacist). With closure skirt portion 62 removed (FIGS. 12 and 13), closure 24 is adapted for non-child-resistant snap-cap mounting onto the container. A circumferentially continuous channel or pocket 68 preferably disposed on the outside surface of annular wall 44 adjacent to base wall 38 receives bead 36 around the open container end by snap-fit. Skirt portion 60 may abut the upper surfaces of container projections 28 in the non-child-resistant mode of operation. External surface 46 of annular wall 44 preferably is in resilient sealing engagement with the opposing inner surface of the container wall to seal the package. Base wall 38 preferably is flat on at least the outside or upper surface, and indicia may be molded or applied to the base wall to advise a user how to open the package and/or how to convert the package to non-child-resistant operation.

There thus have been disclosed a closure, a package and a method of making a closure that, in accordance with the various aspects of the disclosure, fully satisfy all of the objects and aims previously set forth. The disclosure has been presented in conjunction with an exemplary preferred embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A closure that includes a base wall and a circumferentially continuous skirt having a first portion contiguous with the periphery of said base wall and a second portion frangibly connected to said first portion and internal lugs on said second portion of said skirt to resist removal of the closure from a container in a child-resistant mode of operation, wherein at least said second portion of said skirt has a uniform wall thickness and an undulating circumferential contour that includes alternate outwardly convex and outwardly concave portions, and wherein said internal lugs are disposed within said outwardly concave portions and no breakable connectors join said internal lugs to any other portion of the closure, and said second portion of said skirt being frangibly removable from said first portion to remove said internal lugs from the closure such that the closure is convertible from the child-resistant mode of operation to a non-child resistant mode of operation.

2. The closure set forth in claim 1 wherein said skirt is sufficiently flexible to allow said outwardly concave portions to assume an outwardly convex geometry as a result of outward pressure on said internal lugs during demolding of said closure.

3. The closure set forth in claim 1 including an annular wall spaced radially inwardly from said skirt for internal engagement with a container.

4. The closure set forth in claim 3 wherein said annular wall has a circumferentially continuous external pocket for snap-receipt of a container end.

5. A closure of one-piece integrally molded plastic construction that includes a base wall with a peripheral skirt having a first portion contiguous with the periphery of said base wall and a second portion connected to said first portion, internal lugs on said second portion of said skirt, an annular wall extending from said base wall within said skirt and a circumferentially continuous external pocket on said annular wall adjacent to said base wall for snap-receipt with an internal bead of a container in a non-child resistant mode of operation, said second portion of said skirt having all of said internal lugs disposed thereon and being frangibly separable from said first portion of said skirt to remove said internal lugs from the closure such that the closure is convertible from a child-resistant mode of operation to the non-child resistant mode of operation.

6. The closure set forth in claim 5 wherein said skirt has a uniform wall thickness and an undulating circumferential contour that includes alternate outwardly convex and outwardly concave portions, and wherein said internal lugs are disposed within said outwardly concave portions.

7. The closure set forth in claim 6 wherein said skirt is circumferentially continuous.

8. The closure set forth in claim 7 wherein said skirt is sufficiently flexible to allow said outwardly concave portions to assume an outwardly convex geometry as a result of outward pressure on said internal lugs during demolding of said closure.

9. The closure set forth in claim 8 wherein said lugs, as viewed from within said skirt, are each shaped as an inverted U that opens toward a free edge of said skirt.

10. A package having child-resistant and non-child-resistant modes of operation, which includes:

a container having an open end and at least one external engagement element spaced from said open end, and a closure having a base wall, a skirt extending from said base wall, at least one internal engagement element on said skirt for engagement with said at least one external engagement element on said container in a child-resistant mode of operation, at least a portion of said skirt containing said internal engagement element being severable from said closure for non-child-resistant operation of said closure, an annular wall extending from said base wall within said skirt to engage said open end of said container, and an annular pocket in an external surface of said annular wall adjacent to said base wall for snap-receipt over said open end of said container in said non-child-resistant mode of operation.

11. The package set forth in claim 10 wherein said at least one internal engagement element includes an array of angularly spaced internal lugs, and wherein said portion of said skirt has an undulating circumferential contour that includes alternate outwardly convex and outwardly concave portions, said internal lugs being disposed within said outwardly concave portions.

12. The package set forth in claim 11 wherein said skirt is circumferentially continuous.

13. The package set forth in claim 12 wherein said lugs, as viewed from within said skirt, are each shaped as an inverted U that opens toward a free edge of said skirt.

14. A package that includes:

a container having a body with an open end, an internal bead extending around said open end, and an array of external projections around an external surface of said body spaced from said open end, and a closure that includes a base wall and a circumferentially continuous skirt having a first portion contiguous with the periphery of said base wall and a second portion frangibly connected to said first portion and having internal lugs for engaging said external projections of said container, wherein said skirt has a uniform wall thickness and an undulating circumferential contour that includes alternate outwardly convex and outwardly concave portions, and wherein said internal lugs are disposed within said outwardly concave portions and no breakable connectors join said internal lugs to any other portion of the closure, and wherein said closure also includes an annular wall extending from said base wall at a position spaced radially inward from said skirt and having an external surface to engage said open end of said container as said closure is applied to said container, and a circumferentially continuous external pocket on said external surface adjacent to said base wall, wherein said internal lugs of said closure engage said external projections of said container to resist removal of said closure from said container in a child-resistant mode of operation, and said second portion of said skirt being frangibly removable from said first portion to remove said internal lugs from said closure such that said closure is convertible from the child-resistant mode of operation to a non-child resistant mode of operation so that said closure is securable to the container in the non-child-resistant mode of operation by snap-receipt of said pocket with said internal bead of said container.

15. The package set forth in claim 14 wherein said lugs, as viewed from within said skirt, are each shaped as an inverted U that opens toward a free edge of said skirt.

16. A method of making a closure that includes molding a closure of one-piece integrally molded plastic construction having a base wall and a circumferentially continuous skirt having a first portion contiguous with the periphery of said base wall and a second portion frangibly connected to said first portion and internal lugs on said second portion of said skirt, at least said second portion of said skirt having a uniform wall thickness and an undulating circumferential contour that includes alternate outwardly convex and outwardly concave portions, said internal lugs being disposed within said outwardly concave portions and no breakable connectors join said internal lugs to any other portion of the closure.

17. The method set forth in claim 16 wherein said skirt is sufficiently flexible to allow said outwardly concave portions to assume an outwardly convex geometry as a result of outward pressure on said internal lugs during demolding of said closure.

18. A method of making a closure that includes molding a closure of one-piece integrally molded plastic construction having a base wall with a peripheral skirt having a first portion contiguous with the periphery of said base wall and a second portion connected to said first portion, internal lugs on said second portion of said skirt, an annular wall extending from said base wall within said skirt and a circumferentially continuous external pocket on said annular wall adjacent to said base wall for snap-receipt with an internal bead of a container in a non-child resistant mode of operation, said second portion of said skirt having all of said internal lugs disposed thereon and being frangibly separable from said first portion of said skirt to remove said internal lugs from the closure such that the closure is convertible from a child-resistant mode of operation to the non-child resistant mode of operation.

19. The method set forth in claim 18 wherein said skirt has an undulating circumferential contour that includes alternate outwardly convex and outwardly concave portions, and wherein said internal lugs are disposed within said outwardly concave portions.

20. The method set forth in claim 19 wherein said skirt is circumferentially continuous.

21. The method set forth in claim 20 wherein said skirt is sufficiently flexible to allow said outwardly concave portions to assume an outwardly convex geometry as a result of outward pressure on said internal lugs during demolding of said closure.

22. The method set forth in claim 21 wherein said lugs, as viewed from within said skirt, are each shaped as an inverted U that opens toward a free edge of said skirt.

23. The closure set forth in claim 1 wherein said first portion of said skirt is adapted to abut upper surfaces of external projections on the container in the non-child resistant mode of operation.

24. The closure set forth in claim 5 wherein said first portion of said skirt is adapted to abut upper surfaces of external projections on a container in the non-child resistant mode of operation.

25. The package set forth in claim 10 wherein said first portion of said skirt abuts at least one upper surface of said at least one external engagement element on said container in the non-child resistant mode of operation.

26. The package set forth in claim 14 wherein said first portion of said skirt abuts upper surfaces of said external projections on said container in the non-child resistant mode of operation.

27. The package set forth in claim 10 wherein said at least one external engagement element includes a cam portion, a notch, and a stop, and said closure is rotatably applied to said container wherein said at least one internal engagement element engages said cam portion of said at least one external engagement element, said annular wall flexes, and said at least one internal engagement element snaps into said notch, and the package is opened by pushing said closure axially toward said container against the force of said annular wall against said open end of said container until said at least one internal engagement element clears said notch at which point said closure may be rotated to clear said at least one external engagement element.

28. The package set forth in claim 14 wherein said external projections include cam portions, notches, and stops, and said closure is rotatably applied to said container wherein said internal lugs engage said cam portions of said external projections, said annular wall flexes, and said internal lugs snap into said notches, and the package is opened by pushing said closure axially toward said container against the force of said annular wall against said open end of said container until said internal lugs clear said notches at which point said closure may be rotated to clear said external projections.

29. A closure of one-piece integrally molded plastic construction that includes:

a base wall, a peripheral skirt having a first portion contiguous with the periphery of said base wall and a second portion frangibly connected to said first portion and having internal lugs disposed thereon, and an annular wall extending from said base wall and spaced radially inwardly from said skirt for internal engagement with an open end of a container, and having a circumferentially continuous external pocket adjacent to said base wall, wherein said internal lugs engage external projections of the container to resist removal of the closure from the container in a child-resistant mode of operation, wherein said second portion of said skirt is frangibly removable from said first portion to remove said internal lugs from the closure such that the closure is convertible from the child-resistant mode of operation to a non-child resistant mode of operation wherein said circumferentially continuous external pocket provides snap-receipt for an internal bead extending around the open end of the container.

30. A closure that includes a circumferentially continuous skirt and internal lugs on said skirt, wherein said skirt has a uniform wall thickness and an undulating circumferential contour that includes alternate outwardly convex and outwardly concave portions, and wherein said internal lugs are disposed within said outwardly concave portions and, as viewed from within said skirt, are each shaped as an inverted U that opens toward a free edge of said skirt.

31. A method of making a closure that includes molding a closure of one-piece integrally molded plastic construction having a circumferentially continuous skirt and internal lugs on said skirt, said skirt having a uniform wall thickness and an undulating circumferential contour that includes alternate outwardly convex and outwardly concave portions, said internal lugs being disposed within said outwardly concave portions and, as viewed from within said skirt, said internal lugs are each shaped as an inverted U that opens toward a free edge of said skirt.

* * * * *